US008472852B2

(12) United States Patent
Aoyama et al.

(10) Patent No.: US 8,472,852 B2
(45) Date of Patent: Jun. 25, 2013

(54) FIXING DEVICE AND IMAGE FORMING APPARATUS

(75) Inventors: Yuichi Aoyama, Tokyo (JP); Takuma Nakamura, Tokyo (JP); Tetsurou Sasamoto, Tokyo (JP); Masafumi Yamada, Tokyo (JP); Shunichi Abe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 293 days.

(21) Appl. No.: 12/929,494

(22) Filed: Jan. 28, 2011

(65) Prior Publication Data

US 2011/0222924 A1 Sep. 15, 2011

(30) Foreign Application Priority Data

Mar. 9, 2010 (JP) ..... 2010-052087

(51) Int. Cl.
*G03G 15/20* (2006.01)

(52) U.S. Cl.
USPC ..... 399/327; 399/400; 399/67

(58) Field of Classification Search
USPC ..... 399/327, 33, 67, 122, 400
See application file for complete search history.

(56) References Cited

U.S. PATENT DOCUMENTS

| | | | |
|---|---|---|---|
| 5,666,628 | A | 9/1997 | Fukai |
| 7,655,374 | B2 | 2/2010 | Katano et al. |
| 7,713,673 | B2 | 5/2010 | Katano et al. |
| 7,773,932 | B2 | 8/2010 | Katano et al. |
| 7,813,689 | B2 | 10/2010 | Nakamura et al. |
| 2007/0243483 | A1 | 10/2007 | Katano et al. |
| 2008/0213002 | A1 | 9/2008 | Katano et al. |
| 2009/0003903 | A1 | 1/2009 | Katano et al. |
| 2009/0067904 | A1 * | 3/2009 | Katano et al. ..... 399/339 |

FOREIGN PATENT DOCUMENTS

| | | |
|---|---|---|
| JP | 61034574 | 2/1986 |
| JP | 3290513B2 A | 12/1991 |
| JP | 3290513 | 6/2002 |
| JP | 2007219105 A | 8/2007 |
| JP | 2009031645 A | 2/2009 |
| JP | 2009110029 A | 5/2009 |
| WO | WO 2009/125824 | 10/2009 |

OTHER PUBLICATIONS

Extended Search Report for corresponding European patent application No. 11250111.9 dated May 2, 2011.

* cited by examiner

*Primary Examiner* — Walter L Lindsay, Jr.
*Assistant Examiner* — Roy Y Yi
(74) *Attorney, Agent, or Firm* — Harness, Dickey & Pierce, P.L.C.

(57) ABSTRACT

A fixing device includes a foam fixer generator unit generating a foam fixer containing a softener softening toner by dissolving or swelling part of resin of the toner, an application roller carrying and transferring the foam fixer onto a recording sheet, a pressure roller applying pressure to a toner image on the recording sheet via the foam fixer on the application roller to fix the toner image on the recording sheet, a cleaning device removing residual components remaining on the application roller, a recording sheet detector unit detecting presence or absence of the recording sheet, a remover unit being in contact with and separated from the application roller to remove the foam fixer on the application roller, and a control unit controlling the contact-separation operation of the remover unit based on a detected result of a front end and/or a rear end of the recording sheet.

8 Claims, 6 Drawing Sheets

FIXING DEVICE AND IMAGE FORMING APPARATUS

BACKGROUND OF THE INVENTION

1. Field of the Invention

The invention relates to a fixing device and an image forming apparatus having such a fixing device. The invention specifically relates to a fixing device that employs a non-thermal fixing system capable of fixing toner using a foam fixer.

2. Description of the Related Art

Image forming apparatuses such as a printer, a facsimile machine, a photocopier, and a multifunctional peripheral having these functions are generally configured to form images including characters or symbols on recording media such as paper, cloth, and OHP sheets based on image information. In particular, electrophotographic image forming apparatuses are widely used for forming high definition images on plain paper at high speeds. The electrophotographic image forming apparatus generally employs a thermal fixing system capable of fixing images at high fixing speeds with high quality. In the thermal fixing system, toner residing on a recording medium is melted, and pressure is applied to the melted toner on the medium, thereby fixing the toner on the recording medium.

However, in the electrophotographic image forming apparatus having the thermal fixing system, more than half of the power appears to be consumed for heating toner. This may lead the difficulty in improving an energy-savings in the electrophotographic image forming apparatus. In view of recent environmental concerns, the development of a low power consumption (energy-saving) fixing device has attracted much attention. That is, a fixing device having a non-thermal fixing system (hereinafter also called a "non-thermal fixing device") that is capable of fixing toner on a recording medium without heating has been desired.

An example of such a non-thermal fixing device is disclosed in Japanese Patent No. 3290513 (hereinafter called "Patent Document 1"). Patent Document 1 discloses a wet fixing system as an example of the non-thermal fixing system, in which a surface of an object on which an unfixed toner is arranged at a predetermined position is sprayed or droplets are applied with an O/W emulsion fixer composed of an insoluble organic compound dispersed in water and capable of dissolving or swelling toner; after the application of the O/W emulsion fixer on the unfixed toner on the object to dissolve or swell the toner, the object having the dissolved or swollen toner is dried.

In addition, Japanese Patent Application Publication No. 2007-219105 discloses (hereinafter called "Patent Document 2") another example for the non-thermal fixing system, in which a foam fixer formed by dispersing air bubbles in a liquid fixer is applied on a toner image formed on a recording medium. With this foam fixer fixing system, since the fixer is foam, the density of the fixer is lowered. Thus, a film thickness of the (foam) fixer on an application roller may be increased with a smaller amount of the fixer compared to the film thickness of the related art liquid fixer. As a result, it may be possible to reduce an adverse effect of liquid surface tension on the toner particles on the recording medium. Further, in this configuration, since the small amount of the fixer is applied on the toner on the recording medium, residual liquid on the recording medium may be appropriately suppressed, and image degradation due to particle flow caused by the fixer may also prevented. Thus, the toner image may be fixed without degradation using the amount of the fixer smaller than the related art fixer if the toner image is fixed with the foam fixer as described in Patent Document 2.

However, in the fixing device having such a foam fixer fixing system, it may be difficult to cause a foam application mechanism to generate a foam fixer (hereinafter also simply called "foam") onto a sheet of paper in accordance with the sheet transferred to a foam application position in the right place at the right time. One of the reasons for the above may be the difficulty in maintaining the foam fixer formed of the mixture of air and the fixer for a long time. In addition, it may also difficult to generate foam fixer having foam films and foam density suitable for fixing the toner, including the control of the suitable foam films and foam density of the foam fixer. That is, at least the following conditions need to be controlled in forming foam fixer.

1. Foam generation needs to be controlled at a position of a front end of a first sheet.

2. Foam generation needs to be controlled between the continuously transferred sheets; that is, the foam generation needs to be controlled at a position of a rear end of the first sheet and at a position of a front end of a second sheet when sheets are continuously transferred.

3. Foam generation needs to be controlled at a rear end of a last sheet.

However, if the foam needs to be applied over an entire surface of the sheet, more controls need to be satisfied such as foam generation time (time to stabilize foam) or sheet registration variability.

In order to relax the above control conditions, that is, foam generation time, foam generation time between the sheets, and foam generation time after passing through the last sheet, a method for continuously generating foam may be given as an example. However, with this method, the amount of consumed foam may be increased, and hence foam generation may be stopped immediately after the last sheet is passed through the foam application position in order to decrease the amount of consumed foam. It is difficult to control the foam generation time between the sheets if a sheet transferring speed is high. Accordingly, it appears to be easier to control foam generation by the method of continuously generating a foam fixer in order to maintain accuracy and control of the foam generation time. However, continuously generating the foam may induce accumulation of the generated foam around a front end (entrance) of a nip portion where the fixer is applied to the recording medium that has been transferred to the nip portion.

When the foam residing on a foam application roller is applied to and pushed into the recording medium, the foam applied to the recording medium may be pressed with the pressure of a pressure roller. However, if the sheet is not located inside the nip portion, the generated foam that has passed through the nip portion is pushed out from the entrance of the nip portion with the pressure of the pressure roller, thereby accumulating the foam around the nip entrance. The foam is accumulated around the nip entrance because neither the foam application roller nor the pressure roller has a configuration to suction the foam.

Such accumulation of foam around the nip entrance may prevent the recording medium from entering the nip portion, may cause paper jamming, or may attach to both sides of the sheet. Further, the surface of the sheet may have non-uniform foam application. As a result, too much application of the foam may be obtained at the front end of the sheet, thereby degrading sheet separation.

SUMMARY OF THE INVENTION

It is a general object of embodiments of the present invention to provide a fixing device and an image forming apparatus having such a fixing device that substantially obviates one or more problems caused by the limitations and disadvantages of the related art. More specifically, the embodiments are intended to provide a fixing device employing a foam fixer fixing system that includes a recording sheet detector unit configured to detect a front end and/or a rear end of a recording sheet to determine presence or absence of the recording sheet; a remover unit configured to be brought into contact with an application roller and be moved away (separated) from the application roller to remove a foam fixer from the application roller; and a controller unit configured to control operations of the remover unit based on a detected result of the front end and/or the rear end of the recording sheet detected by the recording sheet detector unit.

In one embodiment, there is provided a fixing device that includes a foam fixer generator unit configured to generate a foam fixer containing a softener capable of softening toner by dissolving or swelling at least a part of a resin component of the toner; an application roller configured to carry the foam fixer generated by the foam fixer generator unit to transfer the foam fixer onto a recording sheet; a pressure roller configured to apply pressure to a toner image formed on the recording sheet via the foam fixer applied on the application roller to fix the toner image on the recording sheet; a cleaning device configured to remove residual components remaining on the application roller; a recording sheet detector unit arranged upstream in a recording sheet transfer direction of the fixing device and configured to detect presence or absence of the recording sheet; a remover unit configured to be brought into contact with the application roller and be separated therefrom to remove the foam fixer on a surface of the application roller; and a control unit configured to control the contact-separation operation of the remover unit based on a detected result of a front end and/or a rear end of the recording sheet detected by the recording sheet detector unit.

In another embodiment, there is provided an image forming apparatus that includes the above fixing device.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention will be described with reference to the accompanying drawings. Note that elements, types, combinations, and relative arrangements of the elements described in the following embodiments are only examples and not limited to thereto unless otherwise specified. Various modifications or alteration may be made within the scope of the inventions described in the claims.

Figure 1:
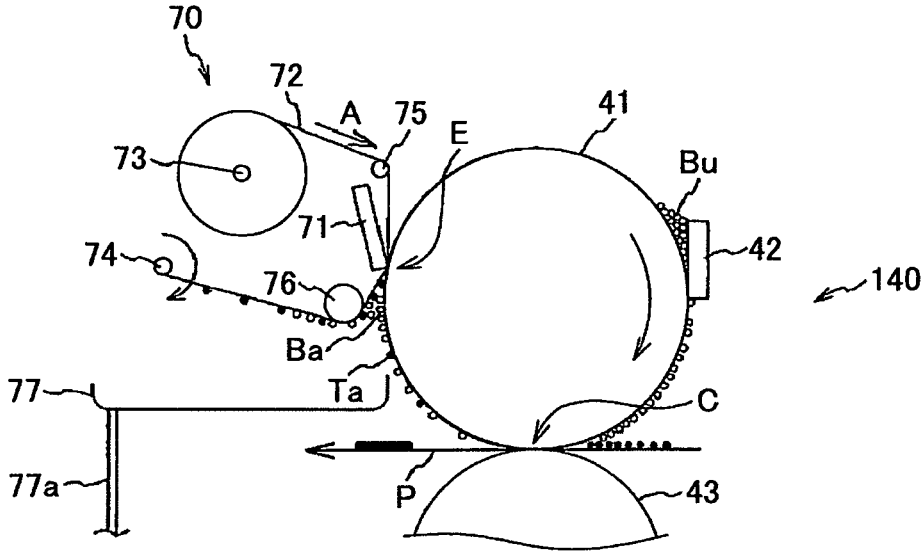
FIG. 1 is an enlarged diagram illustrating an application roller and an application member cleaning device.

FIG. 1 is an enlarged diagram illustrating an application roller and an application member cleaning device in a fixing device according to an embodiment. A foam fixer application section 140 of a fixing device 30 (see FIG. 2) includes an application member cleaning device 70. The application member cleaning device 70 is configured to bring, after a surface of an application roller 41 has passed through an application nip portion C corresponding to an application position of a foam fixer Bu where the foam fixer Bu is applied from the surface of the application roller 41 onto a recording sheet P, a web 72 formed of a PET (polyethylene terephthalate) film member in contact with the surface of the application roller 41 at a position before the surface reaches a supply position of anew foam fixer Bu, where the new foam fixer Bu is supplied to the surface of the application roller 41 by a foam fixer supply section 130 (see FIG. 4).

The application member cleaning device 70 includes the belt-shaped web 72 configured to be brought into contact with the surface of the application roller 41 and be rewound in a surface moving direction opposite to a surface moving direction of the application roller 41, and a film contact blade 71 configured to be brought into contact with the surface of the application roller 41 via the web 72 at a contact position E where the web 72 is in contact with the surface of the application roller 41 so as to be used as a cleaning blade.

In the application member cleaning device 70, the belt-shaped web 72 is wound around a rotational web supply shaft 73 numerous times. A portion of the belt-shaped web 72 on a downstream side in the surface moving direction of the belt-shaped web 72 is wound up by a rotational web winding-up shaft 74. The belt-shaped web 72 is released (supplied) from the rotational web supply shaft 73 in a direction indicated by an arrow A in FIG. 1 in an amount such that the belt-shaped web 72 is wound up by rotationally driving the rotational web winding-up shaft 74 in a clockwise direction as illustrated in FIG. 1.

While a portion of the belt-shaped web 72 between the rotational web supply shaft 73 and the rotational web winding-up shaft 74 is tightened with a predetermined tension, the film contact blade 71 presses the tightened portion of the belt-shaped web 72 on the surface of the application roller 41 with pressing force. The belt-shaped web 72 is pressed by the film contact blade 71 so that the belt-shaped web 72 is brought into contact with the surface of the application roller that has passed through the application nip portion C at the contact position E. In this manner, residual foam fixer Ba and offset toner particles Ta may be blocked at a wedge shaped space (hereinafter also called a "contact position entrance portion") residing at an upstream side of the surface moving direction of the application roller 41.

The application member cleaning device 70 further includes a first guide roller 75 at an upstream side in the surface moving direction (a direction indicated by the arrow A in FIG. 1) of the belt-shaped web 72 relative to the contact position E and a second guide roller 76 at a downstream side in the surface moving direction (a direction indicated by the arrow A in FIG. 1) of the belt-shaped web 72 relative to the contact position E. The application member cleaning device 70 is configured to cause the film contact blade 71 to thrust the belt-shaped web 72 tightened in parallel with a tangential line of the application roller 41 by the first and second guide rollers 75 and 76 such that the film contact blade 71 is in contact with the surface of the application roller 41 via the belt-shaped web 72 at the contact position E, thereby cleaning the surface of the application roller 41.

The front end of the film contact blade 71 is configured to be brought into contact with or separated from the application roller 41 by a not shown contact-separation mechanism, and the belt-shaped web 72 is separated from the application roller 41 when the film contact blade 71 is move away (separated) from the application roller 41. Further, in the application member cleaning device 70, meandering or creasing of the belt-shaped web 72 may be suppressed by the first and second guide rollers 75 and 76. More specifically, in order to suppress the meandering of the belt-shaped web 72, the first and second guide roller 75 and 76 have an hourglass shape or a drum shape; That is, they are configured to each have a central diameter slightly larger than diameters of two ends in the shaft direction of the first and second guide roller 75 and 76.

In the application member cleaning device 70, the belt-shaped web 72 that receives a linear pressure applied by the front end of the film contact blade 71 blocks the residual foam fixer Ba or the offset toner remaining on the surface of the application roller at the contact position entrance so that the residual foam fixer Ba or the offset toner Ta remaining on the surface of the application roller will not enter into the supply position of the (new) foam fixer Bu supplied by the fixer supply section 130. The residual foam fixer Ba or offset toner Ta accumulated around the contact position entrance are adhered to (wiped with) a newly appearing portion of the surface of the belt-shaped web 72 constantly appearing by winding the rotational web winding-up shaft 74 at arbitrary timing.

Note that the belt-shaped web 72 has solvent resistance, and the film contact blade 71 is in contact with the application roller 41 via the belt-shaped web 72. Thus, the film contact blade 71 is not configured to be in direct contact with the fixer applied on the application roller 41. As a result, the film contact blade 71 may not be made of a solvent resistant material in this embodiment. A typical material for the cleaning blade includes urethane rubber. However, in a typical application member cleaning device having a configuration where the cleaning blade is in direct contact with the fixer, and the cleaning blade made of urethane rubber is used for cleaning the application member configured to apply the fixer, such a urethane rubber cleaning blade may be dissolved or swollen with the softener contained in the fixer. Thus, in an application member cleaning device having a configuration where the cleaning blade is directly in contact with the fixer, other materials such as EPDM (ethylene-propylene rubber), silicon, and fluorocarbon rubber may need to be used as the material of the cleaning blade. However, the cleaning blade made of the above materials may have less durability than urethane rubber, which may shorten a component replacement cycle to increase replacement cost due to different lifespans between the components.

In the embodiment, however, the application member cleaning device 70 is configured such that the film contact blade 71 (corresponding to the typical cleaning blade) is pressed and brought into contact with the foam fixer on the application roller 41 via the belt-shaped web 72. With this configuration, even if the film contact blade 71 is made of urethane rubber that is swollen with the softener in the fixer, the film contact blade 71 may be used as the cleaning blade without a cleaning blade swelling problem. Note that in order to satisfy the above condition, a width of the belt-shaped web 72 perpendicular to the surface moving direction of the web 72 needs to be greater than a width of the film contact blade 71.

Note also that it is preferable that the foam fixer Bu be applied to the recording sheet P in a surface area corresponding to a size of the recording sheet P at the application nip portion C. However, in this embodiment, since the foam fixer is applied in the entire area of the recording sheet P, the foam application needs to include an allowance for skews, resist errors, and discontinuous formation of foam fixer between the sheets. However, due to the foam application area including such allowance, the foam fixer Bu may become attached to a surface of the pressure roller 43.

If the foam fixer Bu attached to the pressure roller 43 is not removed, the foam fixer Bu attached to the pressure roller 43 may further be attached to a rear surface of the recording sheet P. The rear surface of the recording sheet P is also configured to be in contact with guide plates or rollers that form a sheet transfer path for the recording sheet P after treated with a fixing treatment. Further, in both-sides printing mode, the rear surface of the recording sheet P may be in contact with toner image carriers such as an intermediate transfer belt or photoreceptor drums, and hence the components of the image forming apparatus may be largely affected. Thus, it is preferable that the pressure roller 43 be also sufficiently cleaned.

Figure 2:
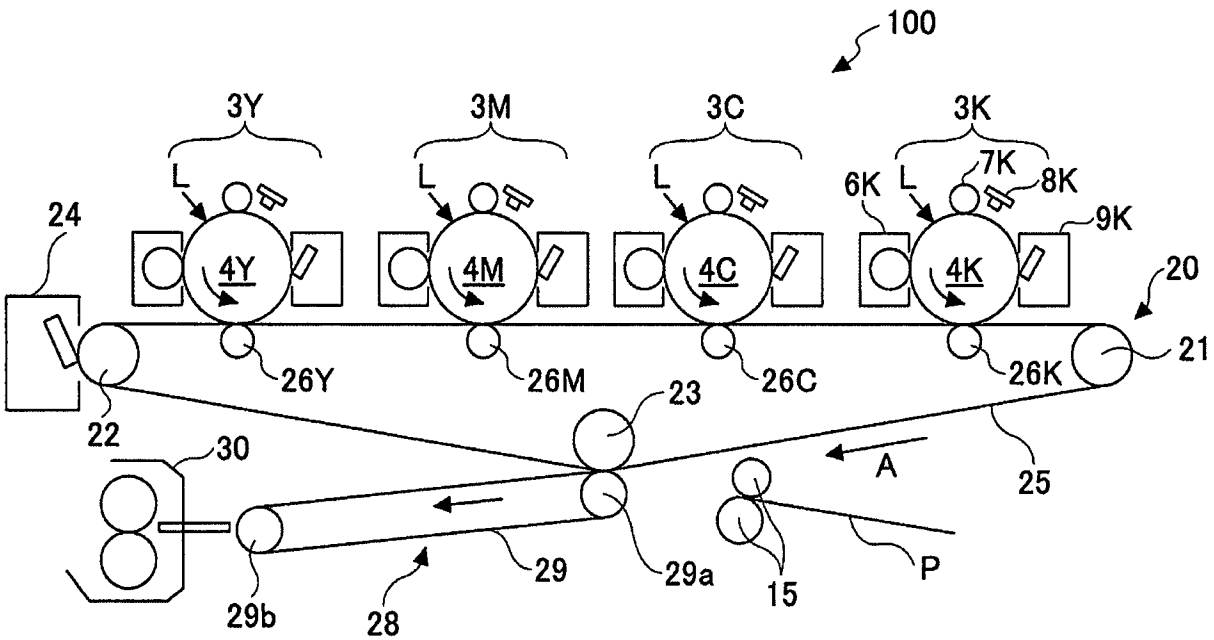
FIG. 2 is a schematic configuration diagram illustrating a main part of a printer.

FIG. 2 is a schematic configuration diagram illustrating a main part of a printer. As illustrated in FIG. 2, a printer 100 includes four process units 18Y, 18M, 18C, and 18K that form corresponding toner images in colors of yellow (Y), magenta (M), cyan (C), and black (K), an image transfer unit 20, a sheet transfer unit 28, a resist roller pair 15, a fixing device 30, and a not-shown optical writing device.

The not-shown optical writing device is configured to emit laser light L toward the photoreceptor drums 4Y, 4M, 4C, and 4K in the corresponding process units 3Y, 3M, 3C, and 3K by driving a light source such as a laser diode or an LED (light emitting diode). By the application of laser light upon the photoreceptor drums 4Y, 4M, 4C, and 4K, corresponding latent images are formed on surfaces of the photoreceptor drums 4Y, 4M, 4C, and 4K. The latent images formed on the surfaces of the photoreceptor drums 4Y, 4M, 4C, and 4K may eventually form toner images after performing a predetermined development process. Note that subscripts Y, M, C, and K provided after reference numerals in FIG. 2 indicate the components are specified for respective colors of yellow, magenta, cyan, and black.

The process units 3Y, 3M, 3C, and 3K respectively include the photoreceptor drums 4Y, 4M, 4C, and 4K used as the latent image carriers and other corresponding peripherals. The process units 3Y, 3M, 3C, and 3K having the respective photoreceptor drums 4Y, 4M, 4C, and 4K, and the corresponding peripherals are each provided as a unit, but are arranged on a common supporting member. Each of the process units 3Y, 3M, 3C, and 3K is detachably attached to a main body of the printer 100. For example, the black process unit 3K includes the black photoreceptor drum 4K, a black development device 6K, a black charging device 7K, a black static eliminator lamp 8K, and a black drum cleaning device 9K.

The photoreceptor drum 4K is formed of an aluminum tube coated with a photoreceptor layer made of an organic photoreceptor material. Note that the photoreceptor drum 4K may be an endless belt type photoreceptor. The black development device 6K has a two-component development system using a two-component developer that contains a magnetic carrier and non-magnetic toner. The black development device 6K forms a black (K) toner image by developing the latent image using the two-component developer. Note that one-component developer that does not contain the magnetic carrier may be used instead of the two-component developer for developing the latent image in the black development device 6K. The black (K) toner image developed on the photoreceptor drum 4K is primarily transferred on the intermediate transfer belt 25 at a later described primary transfer nip portion.

The black drum cleaning device 9K removes residual transferred toner attached to the surface of the black photoreceptor drum 4K that has passed through the primary transfer nip portion. In FIG. 2, a polyurethane rubber cleaning blade configured to remove residual transfer toner is illustrated as the black drum cleaning device 9K; however, the residual transfer toner may be removed by other configurations of the black drum cleaning device 9K.

The black static eliminator lamp 8K is configured to neutralize (discharge) the surface of the black photoreceptor drum 4K by the application of light. The neutralized (discharged) surface of the black photoreceptor drum 4K is uniformly charged by a black charging device 7K to initialize the surface of the black photoreceptor drum 4K. In FIG. 2, a charging roller configured to apply a charging bias to the black photoreceptor drum 4K while rolling on the black photoreceptor drum 4K is illustrated as the black charging device 7K; however, the black charging device 7K may be in other configurations such as a scorotron charger configured to charge the black photoreceptor drum 4K in a contactless manner.

After performing the above described processes, four color Y, M, C, and K toner images are formed on the surfaces of the photoreceptor drums 4Y, 4M, 4C, and 4K of the process units 3Y, 3M, 3C, and 3K. The image transfer unit 20 is arranged beneath the process units 3Y, 3M, 3C, and 3K. In the image transfer unit 20, the intermediate transfer belt 25 looped over belt tightening rollers 21, 22, 23 is brought into contact with the photoreceptor drums 4Y, 4M, 4C, and 4K, thereby forming the corresponding primary transfer nip portions for the four color Y, M, C, and K toner images. The intermediate transfer belt 25 is endlessly moved in a clockwise direction while being rotationally driven by a driving roller 21 in FIG. 2. The primary image transfer rollers 26Y, 26M, 26C, and 26K arranged within a belt loop press the intermediate transfer belt 25 on the photoreceptor drums 4Y, 4M, 4C, and 4K around the corresponding primary transfer nip portions for the four color Y, M, C, and K toner images. The primary image transfer rollers 26Y, 26M, 26C, and 26K are charged with primary image transfer bias by a not-shown power source. Thus, primary image transfer fields are generated in the corresponding primary transfer nip portions to electro-statically move the four color Y, M, C, and K toner images onto the intermediate transfer belt 25. The four color Y, M, C, and K toner images are sequentially superposed on an outer surface of the intermediate transfer belt 25 while the intermediate transfer belt 25 endlessly travels in a clockwise direction to pass through the primary transfer nip portions for the four color Y, M, C, and K toner images. As a result, four color superposed toner images (hereinafter called "four color toner images") are thus formed on the outer surface of the intermediate transfer belt 25 by superposing the four color Y, M, C, and K toner images.

As illustrated in FIG. 2, a sheet transfer unit 28 composed of an endless sheet transfer belt 29, a driving roller 29*b* and a secondary image transfer roller 29*a* is arranged below the image transfer unit 20. In the sheet transfer unit 28, the endless sheet transfer belt 29 is looped over the driving roller 29*b* and the secondary image transfer roller 29*a* to endlessly travel around the driving roller 29*b* and the secondary image transfer roller 29*a*. The endless sheet transfer belt 29 of the sheet transfer unit 28 is sandwiched between the secondary image transfer roller 29*a* and the intermediate transfer belt 25 of the image transfer unit 20. With this configuration, a secondary image transfer nip portion is formed at a position where the outer surface of the intermediate transfer belt 25 is in contact with an outer surface of the sheet transfer belt 29.

The secondary image transfer roller 29*a* of the sheet transfer unit 28 is charged with secondary image transfer bias by a not shown power source. An image transfer backup roller 23 over which the intermediate transfer belt 25 is looped is grounded within the belt loop of the intermediate transfer belt 25 of the image transfer unit 20. With this configuration, a secondary image transfer field is formed in the secondary image transfer nip portion. In FIG. 2, the resist roller pair 15 is arranged on the right-hand side of the secondary image transfer nip portion, and the recording sheet P sandwiched between rollers of the resist roller pair 15 is transferred to the secondary image transfer nip portion in synchronization with the transfer of the four color toner image on the intermediate transfer belt 25. In the secondary image transfer nip portion, the four color toner image on the outer surface of the intermediate transfer belt 25 undergoes secondary transfer to the white recording sheet P by nip pressure, thereby forming a full-color image. Having passed through the secondary nip portion, the recording sheet P is detached from the intermediate transfer belt 25 and transferred to the fixing device 30 by endlessly traveling of the sheet transfer belt 29 while being supported on the outer surface of the sheet transfer belt 29. Residual transfer toner that has not been transferred onto the recording sheet P at the secondary image transfer nip portion is attached on the outer surface of the intermediate transfer belt 25 that has passed through the secondary image transfer nip portion. The residual transfer toner is scraped and removed by a belt cleaning device 24 configured to be brought into contact with the intermediate transfer belt 25.

Figure 3:
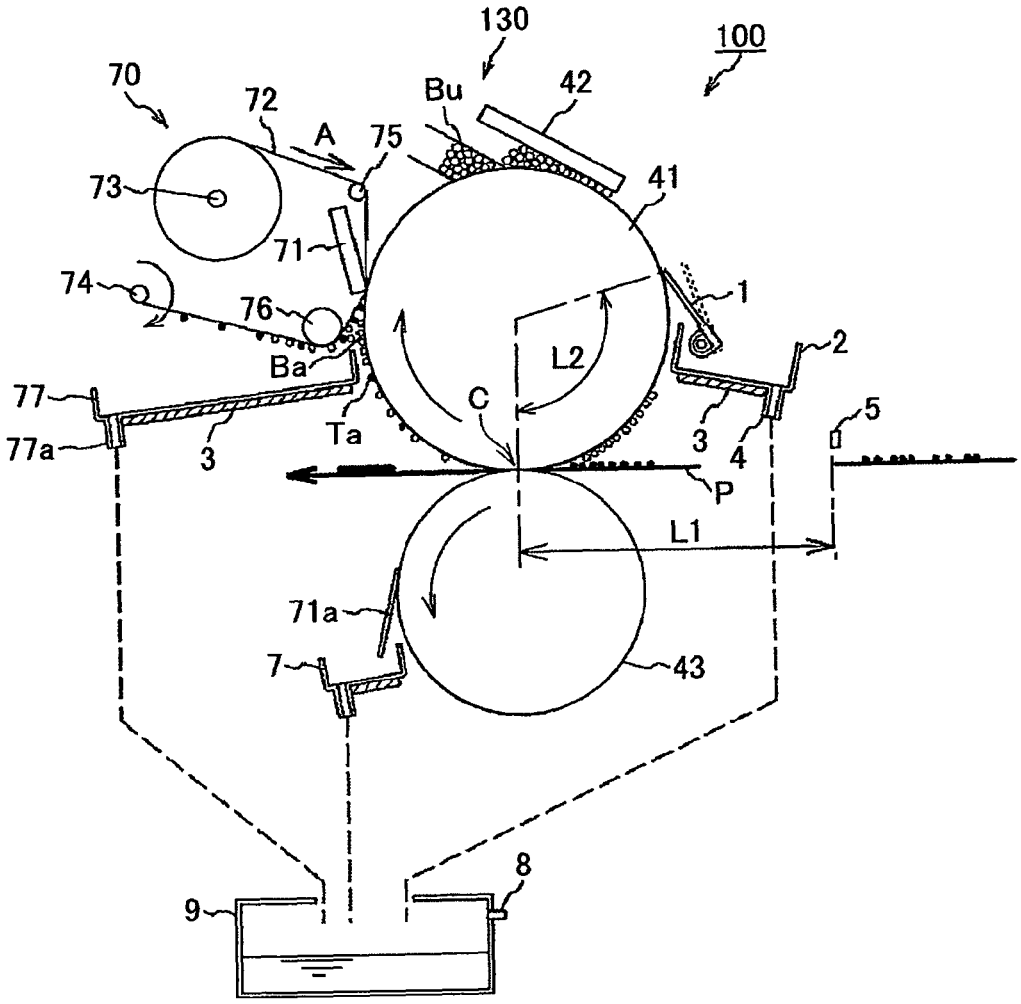
FIG. 3 is a diagram illustrating a configuration of a fixing device according to a first embodiment.

FIG. 3 is a diagram illustrating a configuration of a fixing device according to a first embodiment. Elements identical to those in FIG. 1 are provided with the same reference numerals. The fixing device 100 according to the first embodiment includes a foam fixer supply section 130 (foam fixer generator unit) configured to generate a foam fixer Bu containing a softener capable of softening toner by dissolving or swelling at least a part of a resin component of the toner; an application roller 41 configured to carry the foam fixer Bu generated by the foam fixer supply section 130 to transfer the foam fixer Bu onto a recording sheet P; a pressure roller 43 configured to apply pressure to a toner image formed on the recording sheet P via the foam fixer Bu applied on the application roller 41 to fix the toner image on the recording sheet P; a cleaning device 70 configured to remove residual components remaining on the application roller 41; a sheet end sensor (a recording sheet detector unit) 5 arranged upstream in a recording sheet transfer path of the fixing device 100 and configured to detect presence or absence of the recording sheet P; a blade (a remover unit) 1 configured to be brought into contact with and be separated from the application roller 41 to remove the foam fixer Bu on a surface of the application roller 41; and an inter-sheet blade control circuit (control unit) 16 (see FIG. 6) configured to control a contact-separation operation of the blade 1 based on a detected result of a front end and/or a rear end of the recording sheet P detected by the sheet end sensor 5.

The fixing device 100 according to the first embodiment further includes a collection mechanism. The collection mechanism includes the blade 1 configured to be brought into contact with and/or separated from the application roller 41, an oil pan (a reservoir) 2 configured to temporarily store a portion of the foam fixer Bu collected by the blade 1, a heater (a heater unit) 3 configured to heat an outer side of the oil pan 2 to liquefy the collected foam fixer Bu (the portion of the foam fixer Bu) in the oil pan 2, and a collecting container 9 configured to collect the liquefied foam fixer Bu via a pipe unit such as a drain hose. The timing to bring the blade 1 into contact with the application roller 41 or separate the blade 1 from the application roller 41 may be controlled by the sheet end sensor 5 configured to detect the front end or rear end of the recording sheet P and arranged in a distance farther than a foam moving distance between the blade front end position and the application nip portion C on the surface of the application roller 41. A contact-separation unit of the blade may be generally formed of a combination of solenoid and spring (not shown).

The heater 3 attached to the oil pan 2 is configured to heat the foam fixer Bu collected in the oil pan 2 at a temperature range of 40 to 50° C. to liquefy the foam fixer Bu, thereby exhibiting a sufficient defoaming effect. The residual components are collected by the cleaning device 70 from the portion of the application roller 41 that has passed through the application nip portion C and by a cleaning device 71*a* from the surface of the pressure roller 43, and the collected residual components are then further collected together with the defoamed and liquefied fixer from the oil pan 2 in the collecting container 9. The collecting container 9 is configured to include a full-tank sensor 8, so that a service person or a user may dispose of the collected fixer before the collecting container 9 is filled to overflowing.

Figure 4:
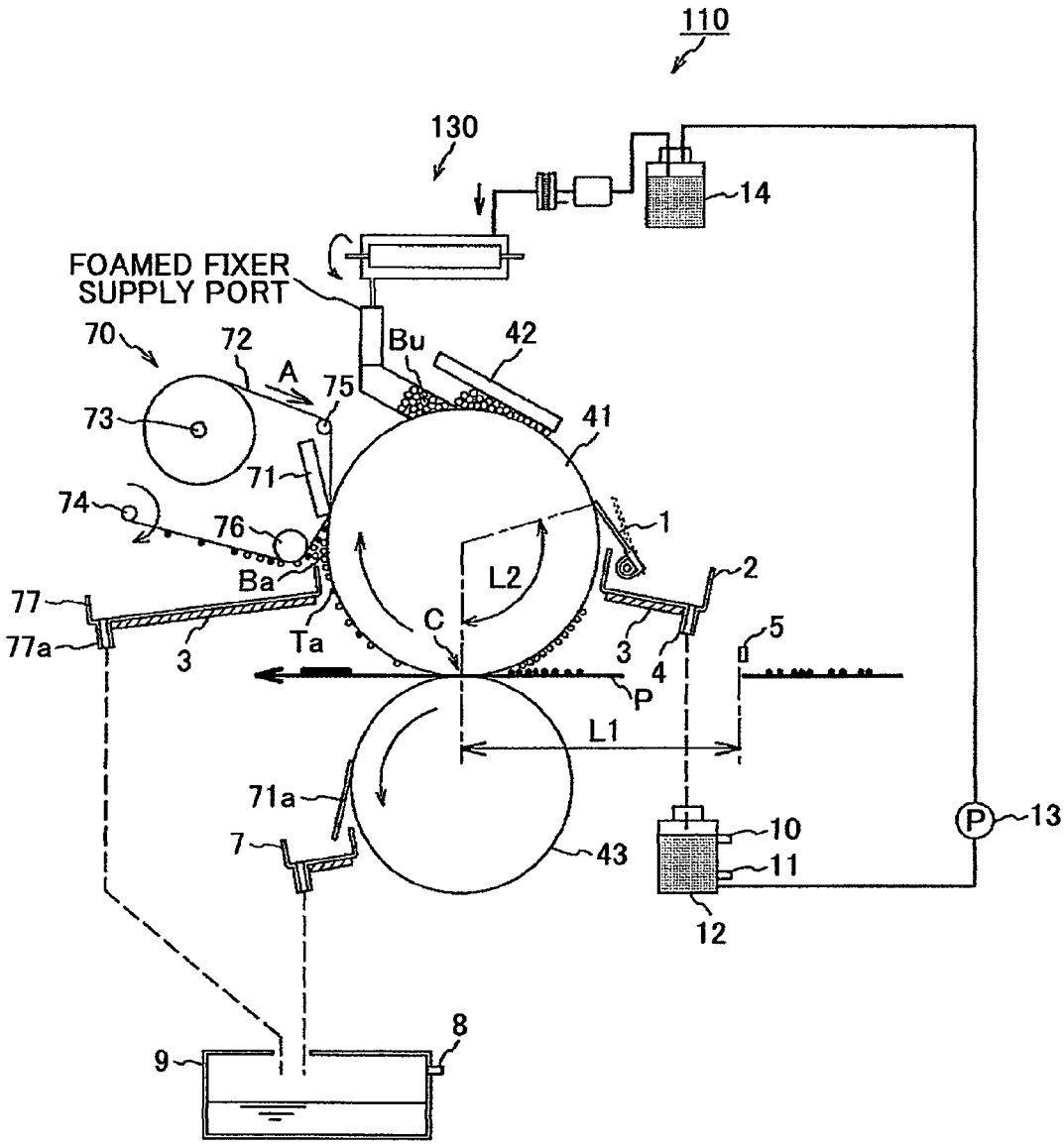
FIG. 4 is a diagram illustrating a configuration of a fixing device according to a second embodiment.

FIG. 4 is a diagram illustrating a configuration of a fixing device according to a second embodiment. Elements identical to those in FIG. 1 are provided with the same reference numerals. A fixing device 110 according to the second embodiment further includes a fixer circulation unit configured to circulate the liquefied fixer collected (stored) in the oil pan 2 via the fixer supply section 130. That is, since the fixer collected from the oil pan 2 is an unused fixer, it is possible to reuse the fixer collected from the oil pan 2. The fixer collected from the oil pan 2 is collected in a collecting container 12 and allowed to stand for a predetermined time. After the collected fixer in the collecting container 12 is cooled to room temperature, the collected fixer is supplied by the pump 13 to a fixer sealing container 14 in order to reuse the collected fixer. If the collected fixer is mixed with air while being supplied into the fixer sealing container 14, the fixer supply condition of the fixer sealing container 14 may be altered. Accordingly, when the collected fixer is supplied into the fixer sealing container 14, air mixing into the fixer needs to be prevented. Thus, the collecting container 12 is provided with the full-tank sensor 10 and a supply end sensor 11 in order to control a supply amount of the fixer. Note that it is possible to prevent air from mixing into the fixer by arranging the supply end sensor 11 at a position higher than a supply port of the collecting container 12.

Figure 5A:
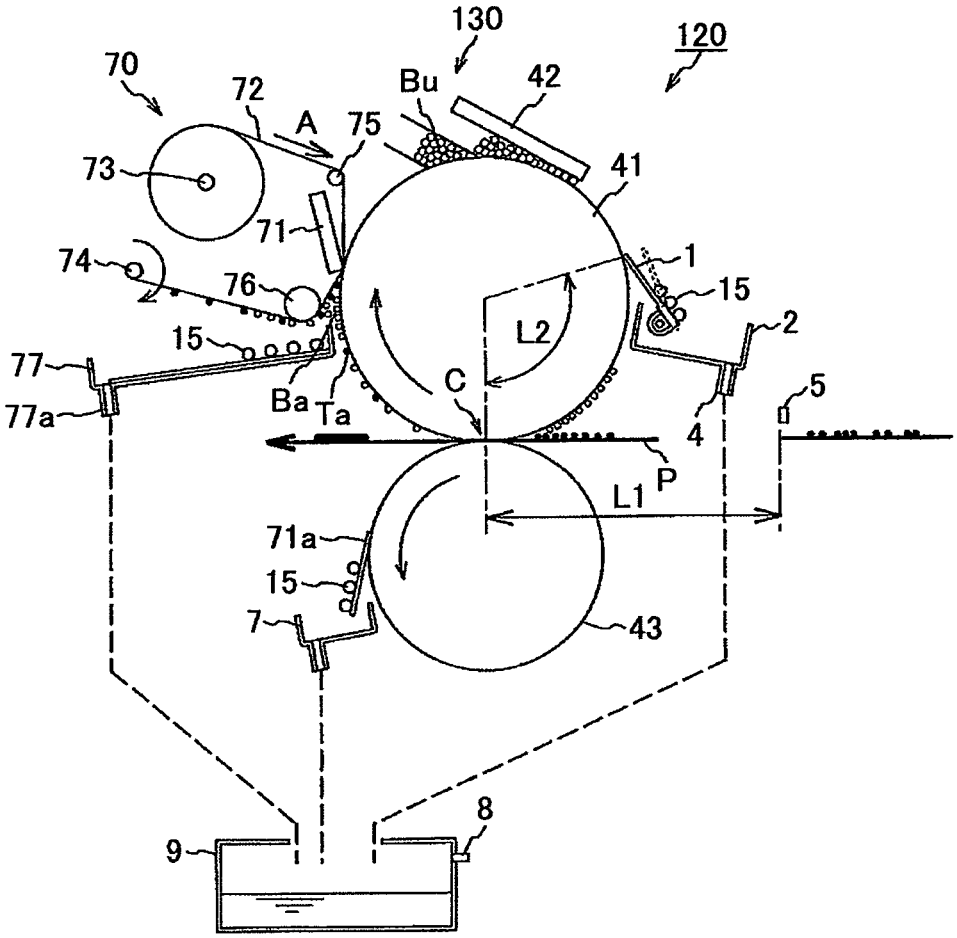
FIG. 5A is a diagram illustrating a configuration of a fixing device according to a third embodiment.
Figure 5B:
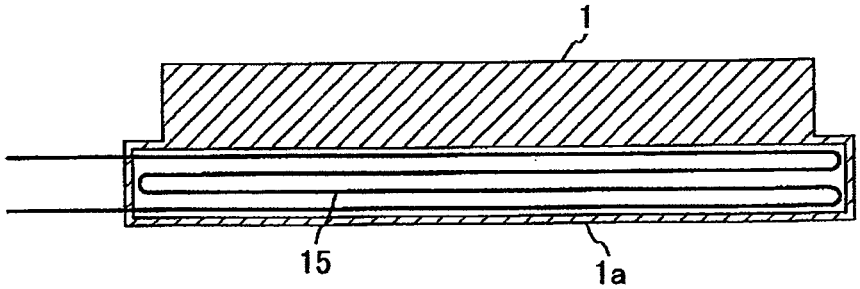
FIG. 5B is an enlarged diagram illustrating a blade used in the fixing device in FIG. 5A.

FIG. 5A is a diagram illustrating a configuration of a fixing device according to a third embodiment, and FIG. 5B is an enlarged diagram illustrating a blade used in the fixing device in FIG. 5A. Elements identical to those in FIG. 1 are provided with the same reference numerals. In the fixing device 120 according to the third embodiment, defoaming of the foam fixer is configured to be carried out near the blade 1 to facilitate defoaming of the continuously collected foam fixer, and heating the collected foam fixer (for defoaming) is carried out in a more efficient manner compared to the use of the oil pan 2. That is, in the heating carried out with the oil pan 2, the entire oil pan 2 needs to be heated, which results in large heat loss. Accordingly, it may not be possible to efficiently heat the collected foam fixer using the oil pan 2. However, in the third embodiment, the blade 1 includes a heating coil (a heater formed of silicon film having a fixer resistance) to heat the foam fixer Bu while the foam fixer is collected by the blade 1 (see FIG. 5B).

Figure 6:
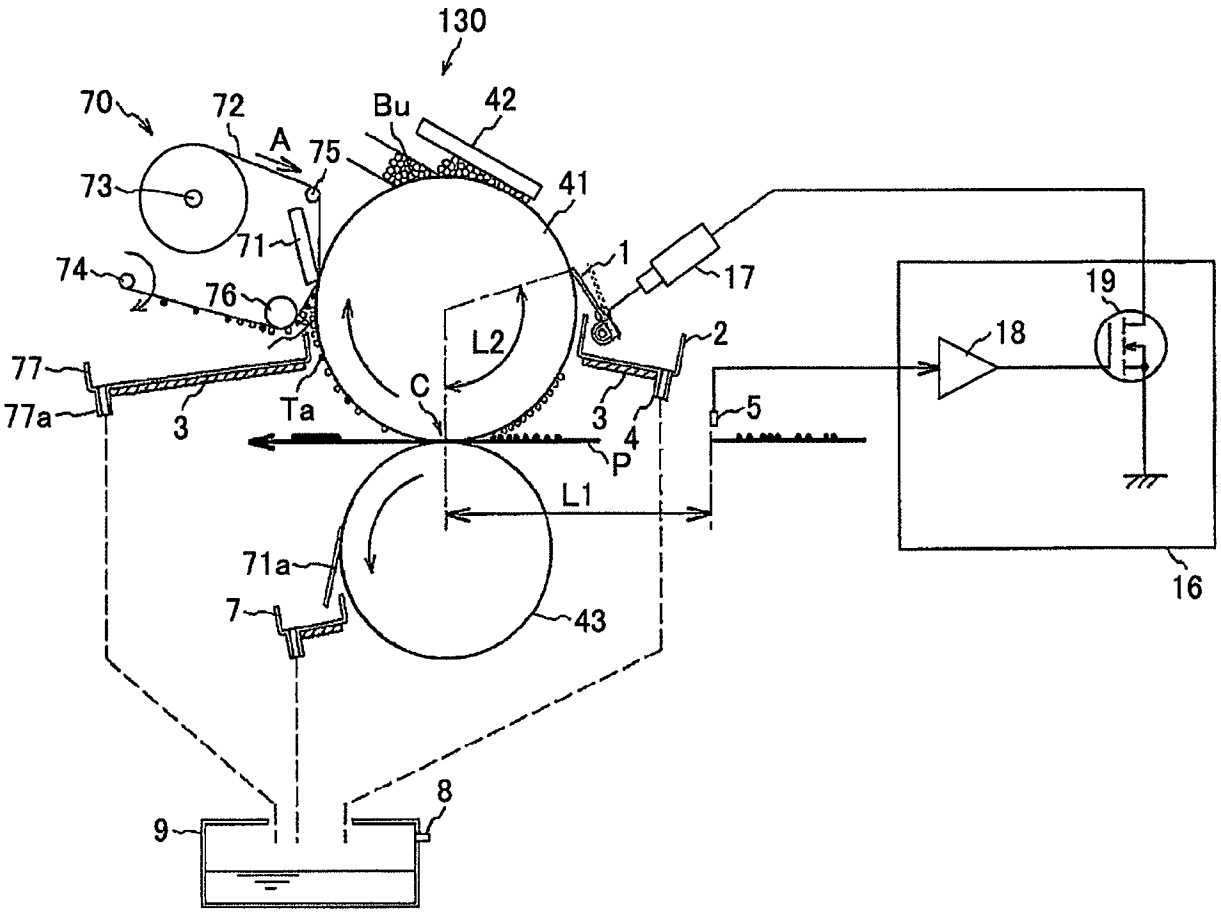
FIG. 6 is a configuration diagram illustrating an operation of the blade provided in the fixing device according to the embodiments.

FIG. 6 is a configuration diagram illustrating an operation of the blade 1 provided in the fixing device according to the embodiments. By bringing the blade 1 into contact with the application roller 41 or separating the blade 1 from the application roller 41, there are a foam fixer Bu applied (existing) portion (in an area where the blade 1 is separated from the application roller 41) and a foam fixer Bu non-applied (non-existing) portion (in an area where the blade 1 is in contact with the application roller 41) on the surface of the application roller 41. Thus, the foam fixer Bu is applied to the surface of the application roller 41 in an area to be in contact with the recording sheet P from the front end through the rear end of the recording sheet P.

If there is no delay time in outputting a signal by the sheet end sensor 5 that detects the front end and the rear end of the recording sheet and no delay time in operating the blade 1 by driving a solenoid 17, and a distance (L2) between a position where the blade 1 is in contact with the application roller 41 and a position where the recording sheet P is in contact with the application roller 41 is configured to be equal to a distance (L1) between a position of the sheet end sensor 5 that detects the front end and the rear end of the recording sheet P and a position where the recording sheet P is in contact with the application roller 41, a signal output by the sheet end sensor 5 detecting the transferred recording sheet is high, and a signal output by an amplifier 18 is high, thereby switching a driver 19 ON to cause the solenoid 17 to separate the blade 1 from the application roller 41 with a circuit configuration illustrated in FIG. 6.

If the sheet end sensor 5 does not detect the transferred recording sheet P, a signal output by the sheet end sensor 5 is low, a signal output by the amplifier 18 is low, thereby switching the driver 19 OFF to cut the conductivity of the solenoid 17, thereby bringing the blade 1 into contact with the application roller 41 by a spring force of a not shown spring. In this manner, the foam fixer Bu may be applied in the area from the front end to the rear end of the transferred recording sheet P, and the foam fixer Bu may not be applied in an area between the preceding transferred recording sheet P and the subsequently transferred recording sheet P at the nip portion.

In practice, although the delay time in outputting the signal by the sheet end sensor 5, on detecting the front end and the rear end of the recording sheet P, maybe negligibly short, the delay time in operating the blade 1 by driving the solenoid 17 is about 0.1 s. That is, if the recording sheet P is transferred at a linear velocity of 300 mm/s, a travel distance for 0.1 s. is 30 mm. This means that the foam fixer may not be applied to the recording sheet in an area within 30 mm of the front end of the recording sheet.

Thus, if a distance (L2) plus 30 mm (+30 mm) between a position where the blade 1 is in contact with the application roller 41 and a position the recording sheet P is in contact with the application roller 41 is configured to be equal to a distance (L1) between the sheet end sensor 5 configured to detect the front end and the rear end of the recording sheet P and a position where the recording sheet P is in contact with the application roller 41, a signal output by the sheet end sensor 5, on detecting the transferred recording sheet P, is high, and a signal output by an amplifier 18 is high, thereby switching on the driver 19 based on the output signals to activate (suction) the solenoid 17 with 0.1 s delay to separate the blade 1 from the application roller 41 in a circuit configuration illustrated in FIG. 6.

If the sheet end sensor 5 does not detect the transferred recording sheet P, a signal output by the sheet end sensor 5 is low, and a signal output by the amplifier 18 is low, thereby switching the driver 19 OFF based on the output signals to cut the conductivity of the solenoid 17, thereby bringing the blade 1 into contact with the application roller 41 with a 0.1 sec delay by the spring force of a not-shown spring. In this manner, the foam fixer Bu may be applied in the area from the front end to the rear end of the transferred recording sheet P, and the foam fixer Bu may not be applied in an area between the preceding transferred recording sheet P and the subsequently transferred recording sheet P at the nip portion.

The fixing device according to the embodiments includes the recording sheet detector unit arranged upstream in a recording sheet transfer path of the fixing device configured to detect presence or absence of the recording sheet; the remover unit configured to be brought into contact with and be separated from the application roller to remove the foam fixer on the surface of the application roller 41; and the control unit configured to control the contact-separation operation of the remover unit based on a detected result of a front end and/or a rear end of the recording sheet detected by the recording sheet detector unit. With this configuration, since the foam fixer is removed from the surface of the application roller excluding the area being in contact with the front end through the rear end of the recording sheet, accumulation of the foam fixer around the application nip portion may be prevented and an excellent sheet transfer performance may be obtained.

According to the embodiments, there is provided a fixing device employing a foam fixer fixing system that includes a recording sheet detector unit configured to detect a front end and/or a rear end of a recording sheet to determine presence or absence of the recording sheet; a remover unit configured to be brought into contact with an application roller and be moved away (separated) from the application roller to remove a foam fixer from the application roller; and a controller unit configured to control operations of the remover unit based on a detected result of the front end and/or the rear end of the recording sheet detected by the recording sheet detector unit. With this configuration, the fixing device is capable of supplying a foam fixer to a position where the recording sheet is present, preventing the foam fixer from accumulating around a front end nip portion, and fixing a toner image using a fixer amount smaller than a related art fixer amount without degrading the toner image.

Further, the present invention is not limited to these embodiments, but various variations and modifications may be made without departing from the scope of the present invention.

The present application is based on Japanese Priority Application No. 2010-052087 filed on Mar. 9, 2010, with the Japanese Patent Office, the entire contents of which are hereby incorporated by reference.

What is claimed is:

1. A fixing device comprising:

a foam fixer generator unit configured to generate a foam fixer containing a softener capable of softening toner by dissolving or swelling at least a part of a resin component of the toner;

an application roller configured to carry the foam fixer generated by the foam fixer generator unit to transfer the foam fixer onto a recording sheet;

a pressure roller configured to apply pressure to a toner image formed on the recording sheet via the foam fixer applied on the application roller to fix the toner image on the recording sheet;

a cleaning device configured to remove residual components remaining on the application roller;

a recording sheet detector unit arranged upstream in a recording sheet transfer direction of the fixing device and configured to detect presence or absence of the recording sheet;

a remover unit configured to be brought into contact with the application roller and be separated therefrom to remove the foam fixer on a surface of the application roller; and a control unit configured to control the contact-separation operation of the remover unit based on a detected result of a front end and/or a rear end of the recording sheet detected by the recording sheet detector unit.

2. The fixing device as claimed in claim 1, wherein a distance from the front end of the recording sheet detected by the recording sheet detector unit to a nip position formed between the application roller and the pressure roller is made equal to a circumferential distance from the nip position formed between the application roller and the pressure roller and a position where the remover unit is brought into contact with the application roller.

3. The fixing device as claimed in claim 1, wherein the remover unit includes: a blade configured to be brought into contact with the application roller to remove a portion of the fixer foam; a reservoir configured to store the portion of the fixer foam removed by the blade; and a heater unit configured to heat the reservoir to liquefy the portion of the fixer foam stored in the reservoir.

4. The fixing device as claimed in claim 3, further comprising:

a fixer circulation unit configured to circulate the liquefied fixer foam stored in the reservoir via the foam fixer generator unit.

5. The fixing device as claimed in claim 3, wherein the heater unit is configured to heat the blade to liquefy the portion of the fixer foam removed by the blade.

6. The fixing device as claimed in claim 3, wherein the remover unit causes the blade to be separated from the application roller during a period between a time where the front end of the recording sheet has been detected by the recording sheet detector unit and a time where the front end of the recording sheet reaches the nip position.

7. The fixing device as claimed in claim 3, wherein the remover unit causes the blade to be in contact with the application roller during a period between a time where the rear end of the recording sheet has been detected by the recording sheet detector unit and a time where a front end of a subsequent recording sheet is detected by the recording sheet detector unit.

8. An image forming apparatus comprising the fixing device as claimed in claim 1.

* * * * *

UNITED STATES PATENT AND TRADEMARK OFFICE

CERTIFICATE OF CORRECTION

PATENT NO. : 8,472,852 B2
APPLICATION NO. : 12/929494
DATED : June 25, 2013
INVENTOR(S) : Yuichi Aoyama et al.

It is certified that error appears in the above-identified patent and that said Letters Patent is hereby corrected as shown below:

Title page, item (75) Inventors should read as follows: Yuichi Aoyama, Kanagawa (JP);
Takuma Nakamura, Kanagawa (JP);
Tetsurou Sasamoto, Kanagawa (JP);
Masafumi Yamada, Kanagawa (JP);
Shunichi Abe, Kanagawa (JP).

Signed and Sealed this
Twenty-fourth Day of September, 2013

Teresa Stanek Rea
*Deputy Director of the United States Patent and Trademark Office*